US005324016A

United States Patent [19]

Beasock et al.

[11] Patent Number: 5,324,016

[45] Date of Patent: Jun. 28, 1994

[54] SELF-ADJUSTING FABRIC PLY PICKING DEVICE

[75] Inventors: Robert J. Beasock, Rome; Hadi M. N. Hamid, New Hartford, both of N.Y.; Timothy G. Clapp, New Hill, N.C.

[73] Assignee: Fruit of the Loom, Bowling Green, Ky.

[21] Appl. No.: 120,566

[22] Filed: Sep. 13, 1993

[51] Int. Cl.[5] ..... B65H 5/00

[52] U.S. Cl. ..... 271/10; 271/21; 271/18.3

[58] Field of Search ..... 271/10, 18.3, 19, 21, 271/16; 414/796.9

[56] References Cited

U.S. PATENT DOCUMENTS

| | | | |
|---|---|---|---|
| Re. 30,084 | 9/1979 | Morton | 271/18.3 X |
| 234,469 | 11/1880 | Griffith et al. . | |
| 492,218 | 2/1893 | Lux . | |
| 747,865 | 12/1903 | Dexter et al. . | |
| 2,042,734 | 6/1936 | Roy | 271/21 |
| 3,031,187 | 4/1962 | Sano et al. | 271/19 |
| 3,253,824 | 5/1966 | Southwell et al. | 271/19 |
| 3,353,821 | 11/1967 | Smith et al. | 271/16 |
| 3,442,505 | 12/1966 | Szentkuti | 271/1 |
| 3,583,695 | 6/1971 | Sherwood | 271/21 |
| 3,940,125 | 2/1976 | Morton | 271/10 |
| 4,019,729 | 4/1977 | Morton | 271/18.3 |
| 4,157,825 | 6/1979 | Ellenberger et al. | 271/10 |
| 4,482,144 | 11/1984 | Glassby | 271/21 |
| 5,180,155 | 1/1993 | Asai | 271/21 |
| 5,181,708 | 1/1993 | Ruch | 271/21 |

*Primary Examiner*—D. Glenn Dayoan
*Assistant Examiner*—Carol L. Druzbick
*Attorney, Agent, or Firm*—Schweitzer Cornman & Gross

[57] ABSTRACT

There is disclosed an improved fabric picking device having a circumferentially toothed picking wheel carried at one end by an elongated inner frame, a shoe adjacent thereto carried by an outer frame, the inner and outer frames being hingedly connected for limited relative movement at their ends opposite the wheel and shoe, of the wheel being responsive independently to controlled spring pressure such that the gap for receiving and pinching fabric between wheel and shoe is rendered self-adjusting for an infinitely variable range of fabric thickness.

6 Claims, 3 Drawing Sheets

SELF-ADJUSTING FABRIC PLY PICKING DEVICE

BACKGROUND OF THE INVENTION

The present invention is an improvement over the fabric picking device described in U.S. Pat. No. 3,940,125 (Morton). More specifically, the device herein described is a fabric picking mechanism with self-adjusting features which eliminate certain problems found in operating the prior device. Except for these new features, their design and operation, the apparatus of the aforesaid U.S. Pat. No. 3,940,125 is hereby incorporated by reference herein.

The fabric picker shown and described in the prior device has the capability of picking a single fabric ply from a stack of material. This equipment has been used commercially for many years but certain inherent problems have resulted which the present invention has solved.

The accuracy of picking single ply material from a stack thereof depends primarily upon the following factors:

a) the pressure transmitted by the picker wheel on the top ply to be picked, which determines proper engagement between the picker wheel and the ply;

b) the clearance between the picker wheel and the shoe to accommodate different thicknesses of fabric; and c) finally the frictional engagement between the bottom of the shoe and the top ply to prevent slippage of the fabric under the shoe when the top ply is engaged by the picker wheel.

In the prior picking device of U.S. Pat. No. 3,940,125 the clearance between the picker wheel and the shoe had to be adjusted manually for different thicknesses of fabric. Setting the clearance using a micrometer screw and feeler gauges is tedious and requires considerable experience. If the clearance is not very close to a recommended figure, the picker will mispick or double pick.

In the prior picking device, the force applied by the picker shoe on the top fabric ply to prevent slippage of fabric under the shoe is generated by a small torsion spring and cannot be significantly altered. Depending upon the slipperiness and stiffness of fabric being picked this spring force may be insufficient to keep intact the top ply and next ply of the stack so that rotation of the picking wheel actually pushes the top ply under the shoe rather than between the wheel and the shoe.

It is the purpose of the present invention to solve these problems which are inherent in the prior picking device.

SUMMARY OF THE INVENTION

The self-adjusting picker of the present invention can accommodate a wide range of fabric thickness without adjustment by the machine operator. This feature not only prevents mispicking or double-picking of fabric plies from a stack of the same fabric, but also prevents mispicking or double-picking from a stack of fabric having different thicknesses without having to adjust for the different thicknesses. Furthermore, in the self-adjusting picker of the invention, the force exerted by the picker shoe on the top ply can be altered to prevent slippage of material under the shoe independently of the pressure needed on the picker wheel to engage the fabric ply being picked.

More specifically, the present invention provides a picking device for selectively removing in sequence, the top ply of fabric from a stack thereof, the device having a rotatable picker wheel, and adjacent thereto, a shoe forming a gap therebetween to receive from said wheel a pinched portion of the said top ply, the device thereafter lifting and peeling the top ply from the stack. In accordance with the present invention, the aforesaid gap to receive such pinched portion of the top ply is preset to receive a minimum thickness. The picker wheel is mounted to an inner frame and the shoe is mounted to an outer frame, each frame being hinged and attached together at the ends thereof opposite to the respective mounting thereto of the picker wheel (inner frame) and the shoe (outer frame).

Attached to the outer frame adjacent to the picker wheel is a torsion spring which exerts a downward force upon the inner frame such that such force initially drives the teeth of the picker wheel into the upper surface of the top fabric ply for picking engagement thereof. However, should the thickness of the ply exceed that required by the aforesaid preset minimum gap, the picker wheel shall experience generally upward pressure by forcing a fold of fabric into the gap between the wheel and shoe. The wheel shall accordingly move generally upwardly against the pressure of the torsion spring to relieve such pressure and automatically self-adjust the gaps to the proper width.

DESCRIPTION OF A PARTICULAR EMBODIMENT

Figure 1:
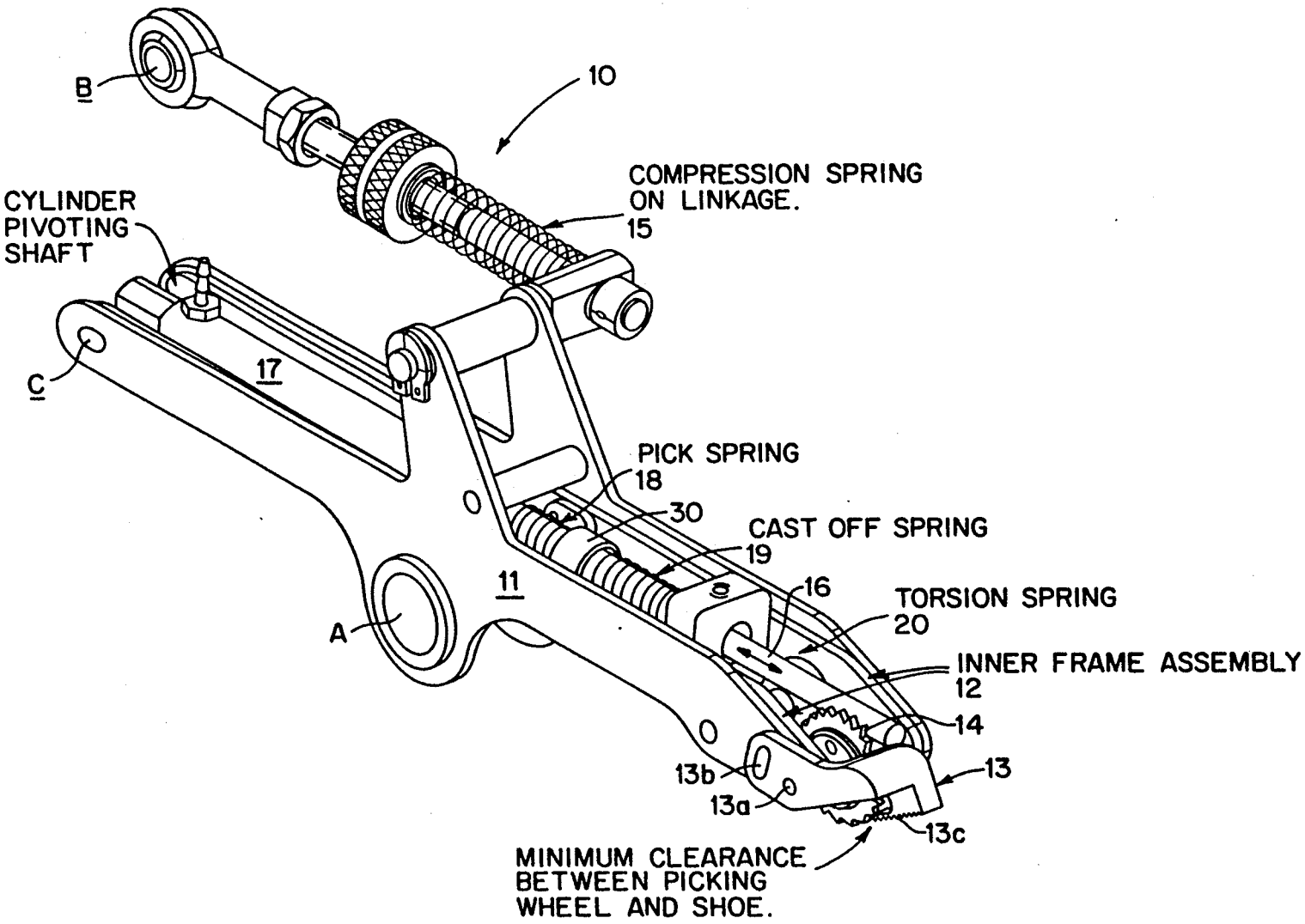
FIG. 1 is an overall isometric view of the self-adjusting picking device of the present invention.

Referring now to the drawing and initially to FIG. 1 thereof, a fabric picking device 10, constructed according to the principles of the present invention has been illustrated. It will be understood that the picking device 10 may be used in combination with apparatus such as that disclosed in U.S. Pat. No. 3,940,125 instead of the picking device (or "ply picking unit") described in that patent; and that furthermore the connection of the picking device 10 of the present invention to the apparatus of the referenced patent may be made in the same or similar manner, such that the picking device 10 can readily replace the ply picking unit of the referenced patent. Accordingly, the picker 10 has attach points and axes of rotation designated A B and C which are generally the same and serve generally the same function as those provided for the ply picking unit of the referenced patent.

The device 10 is constructed to have an outer frame 11 and an inner frame 12 attached thereto for limited relative rotation movement about axis of attached point C. Shoe 13 is attached to the outer frame 11 but may pivot with respect to frame 11 about its connection thereto at 13*a*. This permits the knurled lower surface 13C of the shoe to be positioned flat upon the upper surface of the top ply of a stack independently of the angular position of the frame 11 to which it is attached. Since the height of the stack is maintained during ply removal by raising the stack incrementally, once the initial position of the shoe for a particular stack height has been achieved by rotating the picking unit about axis A, the shoe may be fixed in such position by tightening screws 22 within their mounting holes.

Figures 3A, 3B, 3C, 3D:
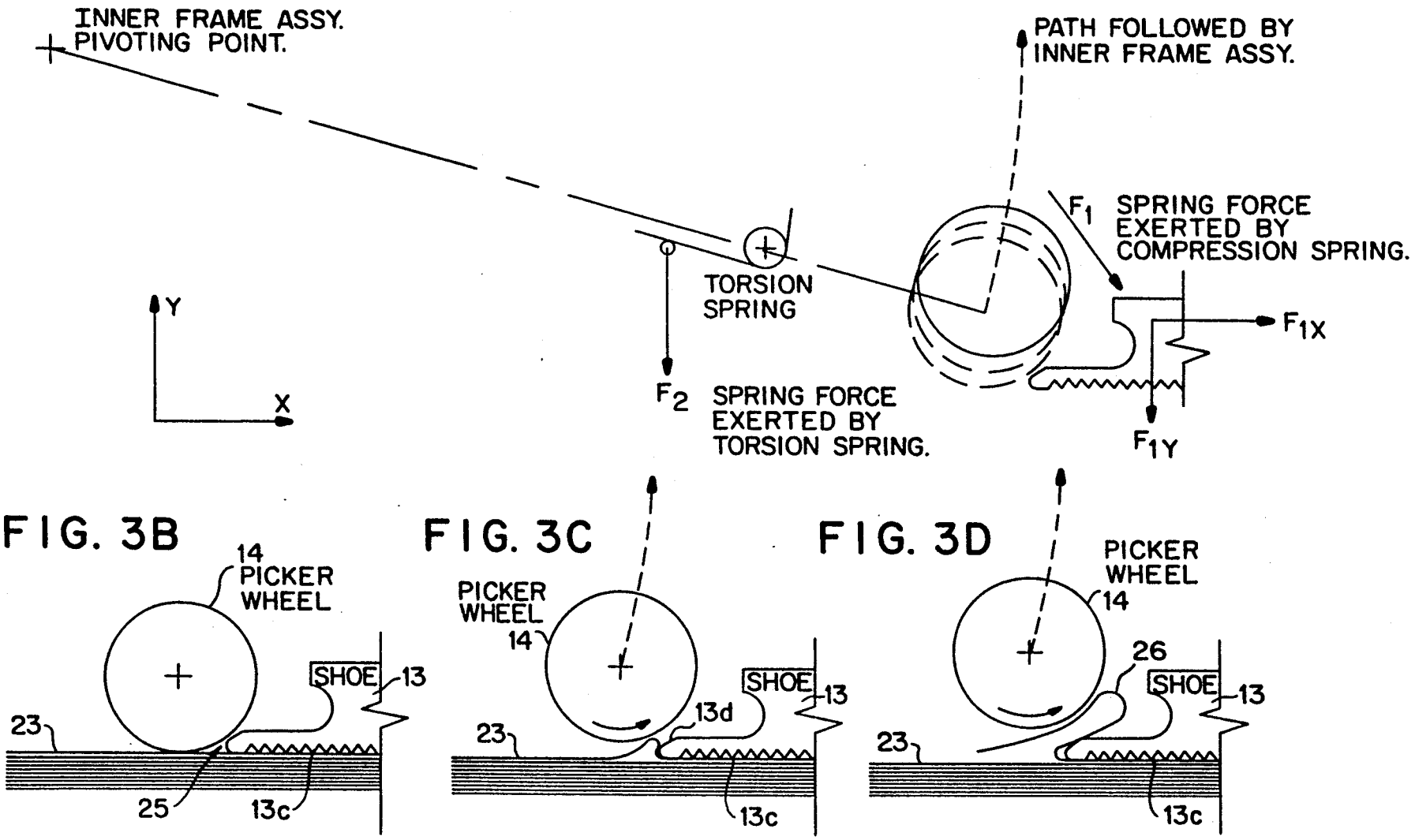
FIGS. 3A–3D diagrammatically illustrate the relationship between the picker wheel, the shoe and torsion spring pressure upon the picker wheel to effect the self-adjusting feature of the invention.

In contrast with the picking unit described in U.S. Pat. No. 3,940,125, the picker wheel 14 is attached to the inner frame 12, along an axis of rotation which is aligned with the rotation of shoe 13 about pivot 13*a*. Rotation of picker wheel 14 in a picking direction, (counter-clockwise as seen in FIGS. 3C and 3D and in a clockwise direction to cast-off) is basically achieved in the same manner shown in the prior device; namely by using a rack attached to the picker wheel 14 and a pinion 16 which engages the rack to effect rotation of wheel 14. As in the prior device, the pinion may be reciprocated by the plunger of an air cylinder actuator 17 and pinion 16 shall be returned to an intermediate position absent air cylinder actuation by the respective actions of pick spring 18 and cast-off spring 19 against collar 30 attached to pinion 16. The inner frame assembly 12 is connected at C to outer frame 11 for limited rotation relative thereto. However, such rotation is restrained immediately adjacent to picker wheel 14 by a torsion spring 20 whose upper short leg 20*a* is attached to collar 21*a* of shaft 21 which is secured to the outer frame 11, the spring being then wrapped around the spring mounting shaft 21 to extend rearwardly along frame 11 to abut stop pin 28 which extends from inner frame 12. Torsion spring 20 thus exerts a force F2 downwardly against the picker wheel mounting end of inner frame 12, about the inner frame assembly pivoting point C toward the stack of fabric plies.

Referring to FIG. 3B, it will be seen that the picker wheel 14 and shoe 13 have been placed into contact with the top ply 23 of a stack preliminary to picking. The pressure of torsion spring 20 shall be chosen to be sufficient to cause the teeth of picker wheel 14 to engage the top ply 23 and the force exerted by compression spring 15 upon outer frame 11 and thus shoe 13 shall be independently set to prevent slipping of the ply 23 under the shoe. The pressure needed will be determined by the slipperiness of the fabric and the respective spring pressures upon wheel 14 and shoe 13 are likely not to be the same. In the prior device, however, since both wheel 14 and shoe 13 were mounted upon the same frame, the single compression spring in the prior device was the primary means of adjusting the contact pressure between the picking wheel, shoe and the upper ply. As mentioned previously, pressure on the shoe could be altered by adjusting a small torsion spring but this was not adequate for the dynamics and range of fabric characteristics involved.

Referring again to FIG. 3B, it will be seen that shoe 13 has been designed to present an inclined surface 13*d* toward the circumference of the adjacent picker wheel 14. Surface 13*d* is generally tangential with respect to the circumference of wheel 14 to form an even elongated opening or gap 25 therebetween. In accordance with the concept of the present invention, gap 25 shall be set to receive the pinched ply upper surface 26 of a minimum thickness ply, allowing the self-adjusting feature of the invention to accommodate a range of thicknesses greater than such minimum thickness.

Figure 2A:
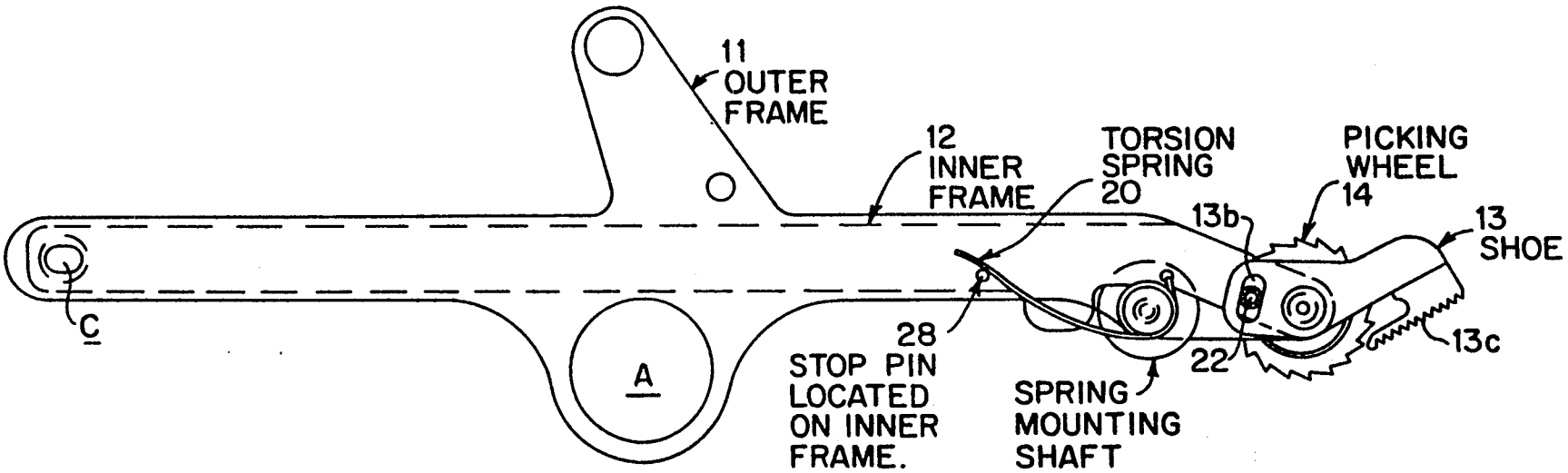
FIGS. 2A and 2B illustrated the controlled spring pressure relationship between the inner frame and outer frame of the picking device shown in FIG. 1.
Figure 2B:
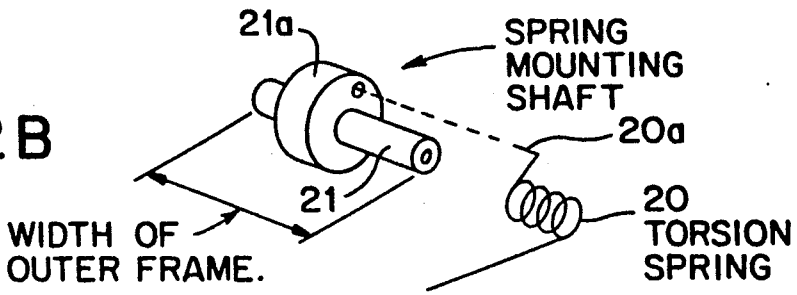

FIGS. 3C and 3D illustrate the self-adjusting feature. FIG. 2C depicts the action of the picker wheel 14 as it begins to force a nipped ply section 25 into the gap between the outer circumference of the wheel and the inclined receiving section 13*d* of shoe 13. The minimum thickness having been exceeded, the pinched material exerts a force upon wheel 14 to thrust wheel 14 upwardly (FIGS. 3C and 3D) away from surface 13*d* against the downward pressure of torsion spring 20 which automatically permits adjustment of gap 25 to accommodate the thickness of the pinched ply. After casting off, the assembly automatically returns to the position of FIG. 3B due to the pressure of torsion spring 20 upon inner frame 12 which carries picker wheel 14.

In accordance with the invention, the following unique objectives have been achieved:

a) the action of compression spring 15 can now be directed solely to pressure upon the shoe 13 and not as previously, upon both shoe and picker wheel; and b) the torsion spring acting upon the picker wheel operates to provide precise penetration for initial nipping of limp fabric plies and also to permit resilient movement of the picker wheel away from the shoe for infinitely variable accommodation of different fabric thicknesses, even within the same stack. Consequently, the picking device of the invention does not need painstaking adjustment each time a different material is picked and mispicking and double-picking are eliminated.

It will be understood that the foregoing description has been of a specific embodiment of the invention and that variations may be made without departing from the inventive concept. In order therefore to understand the scope of the present invention reference should be made to the appended claims.

We claim:

1. In a picking device for pinching a portion of the upper surface of a limp ply of fabric from a stack thereof which includes a picker wheel and a shoe adjacent thereto forming a gap therebetween to receive said pinched portion of fabric, and means for rotating said wheel first to form said pinched portion of fabric, and then to force said pinched portion of fabric into said gap, means for lifting and transporting said wheel and shoe to lift, peel and transport said ply from said stack, and means thereafter to rotate said wheel to cast-off said ply, the improvement comprising:

a) means for setting the gap between said wheel and shoe initially to receive a predetermined minimum thickness of fabric;

b) controlled pressure means sensitive to pressure upon said wheel when a thickness of fabric greater than said predetermined minimum thickness is forced by said wheel into said gap;

c) said controlled pressure means acting thereafter to permit movement of said wheel away from said shoe to allow the said thickness of fabric in said gap to be greater than said predetermined minimum.

2. The picking device of claim 1 wherein the controlled pressure means operates initially to apply pressure to the wheel to enable said wheel frictionally to engage said fabric to form a pinched fold thereof prior to forcing said fold into said gap.

3. The picking device of claim 2 wherein said wheel and said shoe are hinged together for limited independent movement toward and away from said upper surface of said fabric ply and said shoe is responsive to controlled pressure means independent of the controlled pressure means acting upon said wheel.

4. A picking device for removing limp plies of fabric from a stack comprising an outer frame and an inner frame attached to said outer frame for limited rotative movement thereto, means for mounting at the distal end of said inner frame a picker wheel having a circumference constructed to engage a limp ply of fabric, means for mounting at the distal end of said outer frame a shoe, a portion of said shoe being generally tangential to and adjacent to the circumference of said wheel to form a gap therebetween, means to rotate said wheel to cause the circumference thereof to gather a fold in an upper surface of said fabric ply and to move said fold into said gap thereby pinching said fold between said wheel and said shoe, the means for mounting said wheel including controlled pressure means urging said wheel toward said shoe to form said gap therebetween, means for setting said gap to accommodate a predetermined thickness of fabric, said pressure means being responsive to increasing pressure from a thickness of fabric greater than said predetermined thickness being forced into said gap to effect movement of said inner frame in relation to said outer frame to increase said gap to accommodate said greater thickness of fabric.

5. The device according to claim 4 wherein said inner frame is connected to said outer frame in part by spring means responsive to said increasing pressure.

6. The device according to claim 5 wherein said outer frame is responsive to controlled pressure means to bring said shoe into contact with the surface of the ply to prevent slipping of the fabric ply beneath said shoe when said fabric ply is forced by the picker wheel toward and into the gap between said wheel and said shoe.

* * * * *

UNITED STATES PATENT AND TRADEMARK OFFICE

CERTIFICATE OF CORRECTION

PATENT NO. : 5,324,016

DATED : June 28, 1994

INVENTOR(S) : Robert J. Beasock, Hadi M.N. Hamid, Timothy G. Clapp

It is certified that error appears in the above-identified patent and that said Letters Patent is hereby corrected as shown below:

On title page, item [73] should read as follows:

— JET SEW TECHNOLOGIES, INC. —

Signed and Sealed this

Thirty-first Day of January, 1995

*Attest:*

*Attesting Officer*

Bruce Lehman

BRUCE LEHMAN

*Commissioner of Patents and Trademarks*